US009962758B2

(12) United States Patent
Kilibarda et al.

(10) Patent No.: US 9,962,758 B2
(45) Date of Patent: May 8, 2018

(54) CONTINUOUS FASTENER FEEDING APPARATUS AND METHOD

(71) Applicant: Comau LLC, Southfield, MI (US)

(72) Inventors: Velibor Kilibarda, Bloomfield, MI (US); William Maybee, Southfield, MI (US)

(73) Assignee: Comau LLC, Southfield, MI (US)

( * ) Notice: Subject to any disclaimer, the term of this patent is extended or adjusted under 35 U.S.C. 154(b) by 0 days. days.

(21) Appl. No.: 15/688,064

(22) Filed: Aug. 28, 2017

(65) Prior Publication Data

US 2017/0355013 A1 Dec. 14, 2017

Related U.S. Application Data

(62) Division of application No. 14/173,298, filed on Feb. 5, 2014, now Pat. No. 9,808,857.

(60) Provisional application No. 61/761,050, filed on Feb. 5, 2013.

(51) Int. Cl.
*B21J 15/32* (2006.01)
*B21J 15/02* (2006.01)

(52) U.S. Cl.
CPC ..... *B21J 15/323* (2013.01); *B21J 15/025* (2013.01); *Y10T 29/5377* (2015.01)

(58) Field of Classification Search
USPC ..... 242/555.3; 221/104, 107
See application file for complete search history.

(56) References Cited

U.S. PATENT DOCUMENTS 3,189,293 A 6/1965 Prager
3,208,657 A 9/1965 Cohn
3,589,957 A 6/1971 Cohn
3,769,124 A 10/1973 Johnson
4,392,291 A 7/1983 Iai
4,410,103 A 10/1983 Fuhrmeister
(Continued)

FOREIGN PATENT DOCUMENTS

DE 3613096 A1 10/1987
DE 19935853 A1 4/2000
(Continued)

OTHER PUBLICATIONS

Stefan Niederer, "Reel Changes on the Fly", Rebuilders, 2012, web page at http://voith.com/en/twogether-article-33-en-27-reel-changes-on-the-fly.pdf.
(Continued)

*Primary Examiner* — Hemant M Desai
*Assistant Examiner* — Tanzim Imam
(74) *Attorney, Agent, or Firm* — Young Basile Hanlon & MacFarlane, P.C.

(57) ABSTRACT

Methods and apparatuses for continuous fastener feeding for sequentially delivering single fasteners to a fastener installation device are disclosed. In one embodiment the apparatus includes a first fastener reel for supporting a first fastener tape securing a plurality of fasteners and a second fastener reel for supporting a second fastener tape for securing a plurality of fasteners. A fastener tape joining device positioned downstream of the first and second fastener reels receives the respective first and the second fastener tapes and selectively engage the first and second fastener tapes when one of the fastener tapes becomes depleted of fasteners.

9 Claims, 11 Drawing Sheets

(56) References Cited

U.S. PATENT DOCUMENTS

| | | | | |
|---|---|---|---|---|
| 4,673,142 | A | 6/1987 | Keene et al. | |
| 4,842,681 | A * | 6/1989 | Bader | B65H 19/14 156/159 |
| 4,875,633 | A | 10/1989 | Mochizuki et al. | |
| 4,934,621 | A | 6/1990 | Jacobs | |
| 5,136,873 | A | 8/1992 | Hopkins et al. | |
| 5,189,514 | A | 2/1993 | Roden | |
| 5,253,819 | A | 10/1993 | Butler, Jr. | |
| 5,333,803 | A | 8/1994 | Planeta | |
| 5,339,983 | A | 8/1994 | Caple | |
| 5,442,155 | A | 8/1995 | Nihei et al. | |
| 5,481,085 | A | 1/1996 | Kovacevic et al. | |
| 5,534,705 | A | 7/1996 | Terawaki et al. | |
| 5,570,187 | A | 10/1996 | Nihei et al. | |
| 5,691,815 | A | 11/1997 | Huber et al. | |
| 5,709,355 | A | 1/1998 | Kinnunen et al. | |
| 5,741,096 | A | 4/1998 | Olds | |
| 5,762,284 | A | 6/1998 | Rautiainen et al. | |
| 6,164,489 | A * | 12/2000 | Altrock | B23P 19/001 221/1 |
| 6,301,948 | B1 | 10/2001 | Weiland | |
| 6,547,909 | B1 | 4/2003 | Butterworth | |
| 6,554,220 | B2 | 4/2003 | Gambini | |
| 6,792,987 | B2 * | 9/2004 | Monroe | B65H 19/1852 156/351 |
| 7,123,982 | B2 | 10/2006 | Mauer et al. | |
| 7,135,083 | B2 | 11/2006 | Middelstadt et al. | |
| 7,423,734 | B1 | 9/2008 | Luik | |
| 7,618,004 | B2 | 11/2009 | Gelli et al. | |
| 2002/0084260 | A1 | 7/2002 | Kubota et al. | |
| 2002/0145031 | A1 | 10/2002 | Hirano et al. | |
| 2003/0168548 | A1 | 9/2003 | Kinnunen et al. | |
| 2005/0041852 | A1 | 2/2005 | Schwarz et al. | |
| 2007/0108250 | A1 | 5/2007 | Odoni et al. | |
| 2008/0230646 | A1 * | 9/2008 | Morelli | B65H 19/1868 242/555.6 |
| 2008/0251559 | A1 | 10/2008 | Uejima et al. | |
| 2008/0314887 | A1 | 12/2008 | Stoger et al. | |
| 2009/0242686 | A1 | 10/2009 | Oelen et al. | |
| 2010/0314362 | A1 | 12/2010 | Albrecht | |
| 2010/0326962 | A1 | 12/2010 | Calla et al. | |
| 2011/0284508 | A1 | 11/2011 | Miura et al. | |
| 2012/0234805 | A1 | 9/2012 | Schwarz | |
| 2013/0043225 | A1 | 2/2013 | Schurmann | |
| 2015/0101175 | A1 | 4/2015 | Xi et al. | |
| 2016/0175976 | A1 | 6/2016 | Denis et al. | |

FOREIGN PATENT DOCUMENTS

| | | | | |
|---|---|---|---|---|
| DE | 19930087 | A1 | 1/2001 | |
| DE | 102009058817 | | 8/2010 | |
| EP | 2647450 | A1 | 10/2013 | |
| JP | H0523851 | A | 2/2993 | |
| WO | 9301014 | A1 | 1/1993 | |
| WO | WO 9301014 | A1 * | 1/1993 | B21J 15/02 |
| WO | 03086695 | A1 | 10/2003 | |
| WO | 2005005089 | A1 | 1/2005 | |
| WO | 2005095043 | A1 | 10/2005 | |
| WO | 2010000534 | A1 | 1/2010 | |

OTHER PUBLICATIONS

Voith, "FlyingSplice for fully automatic reel change", May 27, 2013, video at http://www.youtube.com/watch?v=2niHex-hHN8.

Notification of Transmittal of the International Search Report and the Written Opinion of the International Searching Authority, or the Declaration, dated May 21, 2014.

European Search Report, EP Application No. 14749030.4, dated Sep. 7, 2016.

International Search Report and Written Opinion of the International Searching Authority in a related matter, dated Jul. 11, 2014.

LMI Technologies, Inc. Gocator 2000 Series Data Sheet.

International Search Report and the Written Opinion of the International Searching Authority, in a related matter, dated Jul. 24, 2015.

CIMTEC Automation Blog, "LMI Technologies Announces Gocator Firmware Release 3.3", Friday, May 11, 2012, http://b log. cimtecauto mation.com/1m i-tech nologies-announces-gocato r-fi rmware-re lease-3-3.

* cited by examiner

CONTINUOUS FASTENER FEEDING APPARATUS AND METHOD

CROSS REFERENCE TO RELATED APPLICATIONS

This divisional application claims priority benefit to U.S. patent application Ser. No. 14/173,298 filed Feb. 5, 2014 which claims priority benefit to U.S. Provisional Patent Application No. 61/761,050 filed Feb. 5, 2013, both applications are incorporated herein by reference in their entirety.

FIELD OF THE DISCLOSURE

The invention generally pertains to fastener delivery systems for high-volume assembly facilities.

SUMMARY OF THE DISCLOSURE

The present invention provides a device and process for continuously providing fasteners, for example self-piercing rivets, to a high-volume robotic vehicle assembly line. The invention greatly improves on the downtime and manpower requirements of conventional robotic rivet systems which frequently require manual reloading of the fastener feed systems to support the production build. The embodiments herein provide the benefit of a second source of fasteners that automatically provides fasteners when a first source is depleted. The first depleted source can then be replaced at any time during the life of the second source.

In one example, a continuous fastener feeding device for use in sequentially delivering single fasteners to a fastener installation device is disclosed. The feeding device comprises a first fastener reel for supporting a first fastener tape securing a plurality of fasteners and a second fastener reel for supporting a second fastener tape for securing a plurality of fasteners. A fastener tape joining device is included and positioned downstream of the first and second fastener reels operable to receive the respective first and the second fastener tapes and selectively engage the first and second fastener tapes when one of the fastener tapes becomes depleted of fasteners.

In another example, a rivet setting system for fastening a plurality of materials together using self-piercing rivets is disclosed. The rivet setting system comprises a self-piercing rivet gun for installation of rivets along an assembly line, a first fastener reel for supporting a first rivet tape securing a plurality of self-piercing rivets, a second fastener reel for supporting a second rivet tape for securing a plurality of self-piercing rivets, and a rivet reel support rack to retain the first and second fastener reels. The system also includes a fastener tape joining device positioned downstream of the first and second fastener reels, operable to receive the respective first and the second fastener tapes and selectively engage the first and second fastener tapes when one of the fastener tapes becomes depleted of rivets.

An example of a method for continuously feeding fasteners to a fastener installation device is also disclosed. The method comprises the steps of feeding a first fastener tape having a tail end from a first fastener reel through a tape joining device toward a fastener installation device, positioning a second fastener tape having a leading end in the tape joining device in spaced proximity to the first fastener tape, and selectively engaging the tail end of the first fastener tape to the leading end of the second fastener tape when the first fastener tape is depleted of fasteners wherein the second fastener tape begins supplying fasteners to the fastener installation device.

Additional features and functions are described below and illustrated in the accompanying drawings. Other features and functions known by those skilled in the art are included within the scope of the invention.

BRIEF DESCRIPTION OF THE DRAWINGS

The description herein makes reference to the accompanying drawings wherein like reference numerals refer to like parts throughout the several views, and wherein.

DETAILED DESCRIPTION

Referring to FIGS. 1-7, examples of a continuous feed rivet setting system 10 for installing a self-piercing rivet into a workpiece 11 are illustrated. Rivet setting system 10 may include an self-piercing rivet gun 12 operably connected to a programmable robot 14 for manipulating and controlling operation of rivet gun 12 for installation of rivets along an assembly line, for example a vehicle assembly line (not shown). Rivet gun 12 may include various configurations suitable for a particular application as known by those skilled in the art.

Figure 1:
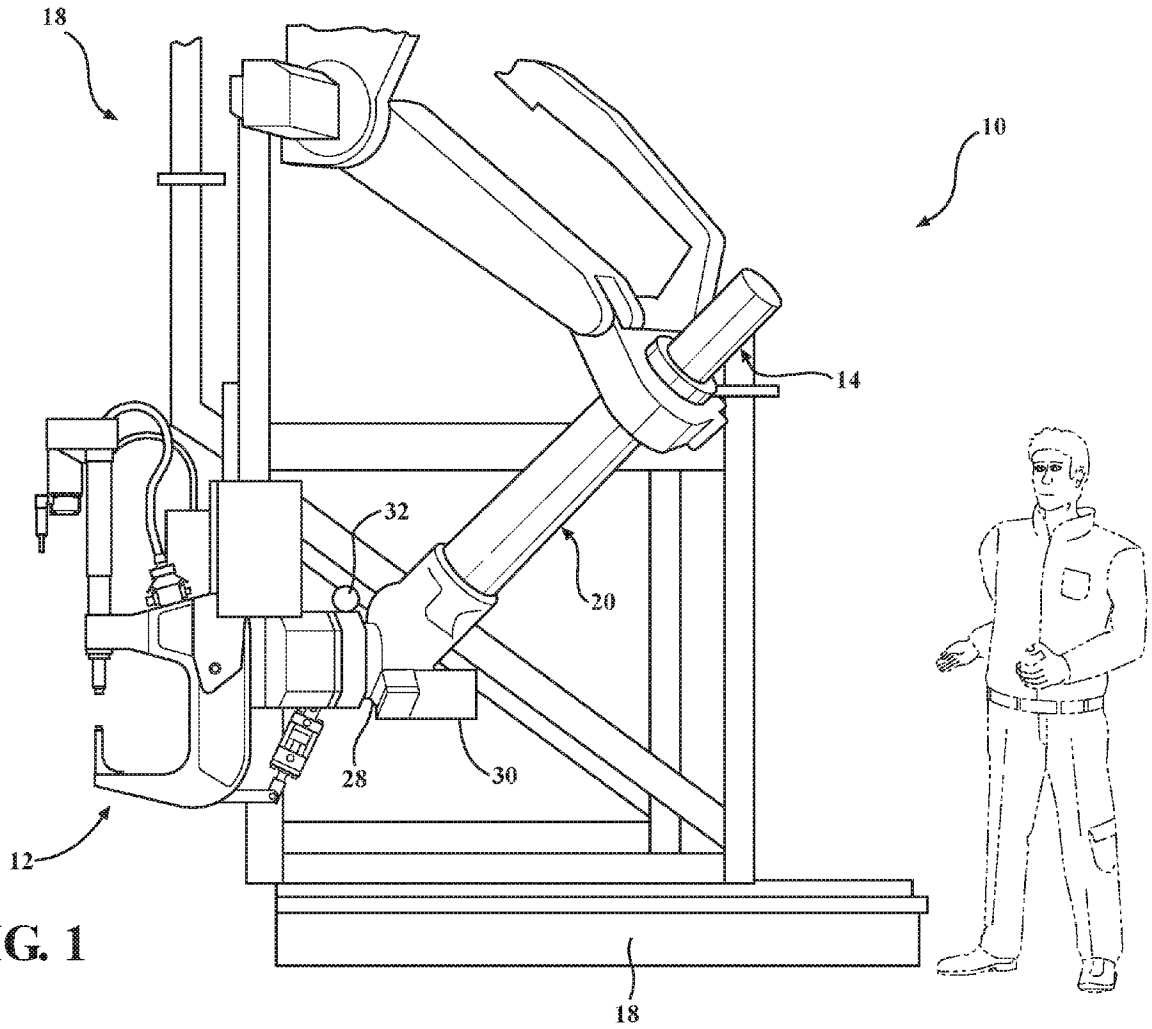
FIG. 1 is a side view of an example of an robotic self-piercing rivet gun assembly station positioned along an assembly line.

In the example shown in FIG. 1, robot 14 is suspended from a scaffolding structure 18. Further details of the scaffolding structure are included in U.S. Pat. No. 8,201,723 assigned to the assignee of the present invention, the entire contents of which is incorporated by reference. Structure 18 supports robot 14 articulating arm 20 including a wrist 28 attached to arm 20 and configured for enabling motion in multiple degrees of freedom. A drive mechanism 30 may be employed for selectively controlling operation wrist 28.

Drive mechanism 30 may include one or more servo motors and other control devices. Rivet gun 12 may be attached to robot 14 by releasably engaging a connector face plate 32 attached to wrist 28 with a connector plate 33 on rivet setting device 16. Other robot and configurations and orientations to support and manipulate rivet gun 12 may be used as known by those skilled in the art. Other connection or mounting structures and methods between the rivet gun 12 and robot 14 known by those skilled in the art may be used.

Figure 2:
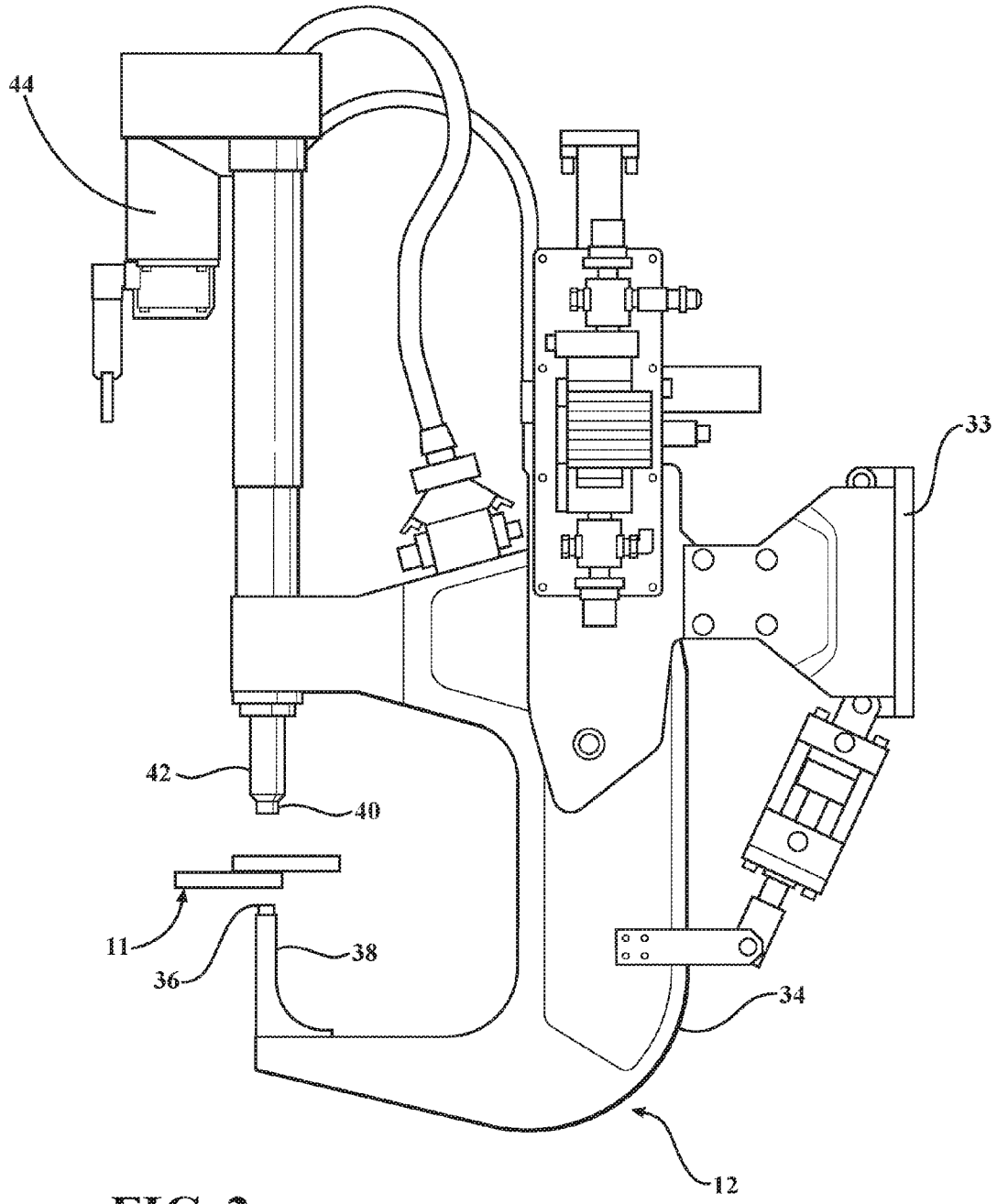
FIG. 2 is an enlarged side view of the self-piercing rivet gun shown in FIG. 1.

With reference to FIG. 2, an example of a self-piercing rivet gun 12 usable with the present invention is illustrated. In the example, rivet gun 12 may include a generally C-shaped frame 34 attached to connector plate 33 of rivet gun 16. A rivet die 36 may be mounted to one end 38 (a lower end in the illustrated exemplary configuration) of C-shaped frame 34. A rivet punch 40 may be mounted to an opposite end 42 (an upper end in the illustrated exemplary configuration) of C-shaped frame 34. Rivet punch 40 is positioned opposite rivet die 36 to enable rivet punch 40 to sequentially move in and out of contact with rivet die 36. A rivet punch drive mechanism 44 may be employed for forcibly moving rivet punch 40 toward and away from rivet die 36. Rivet drive mechanism 44 may include an electric drive motor, or another suitable drive mechanism, for apply an actuating force to rivet punch 40 to forcibly press a self-piercing rivet 46 held in rivet punch 40 into rivet die 36. Rivet drive mechanism 44 may also be used to retract rivet punch 40, for example, by reversing operation of the drive mechanism. Other configurations and operation of rivet gun 12 suitable for the particular assembly operation known by those skilled in the art may be used.

With particular reference to FIGS. 3 and 6A-C, a self-piercing rivet 46 generally includes a large diameter head 48 attached to a hollow shank 50 extending downward from the head. Rivet 46 is generally configured to be rotationally symmetrical. Shank 50 may include a central hollow cavity 52 that may be configured as a blind hole. A distal end 54 of shank 50 may include a beveled cutting edge 56. Other rivet structures and configurations known by those skilled in the art may be used.

Figure 3:
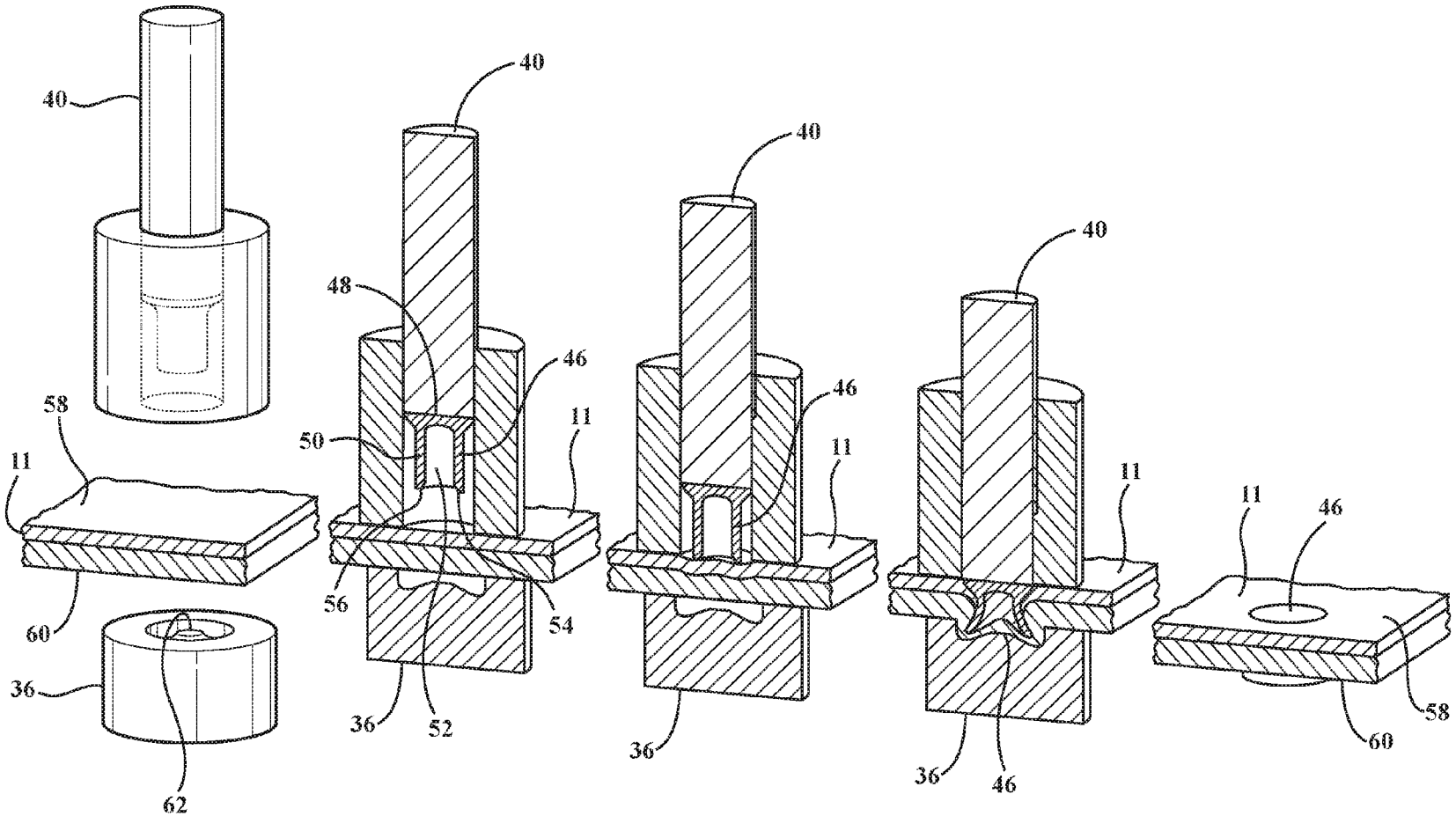
FIG. 3 is a schematic view of an example of a self-piercing riveting sequence.

FIG. 3 illustrates an exemplary process of using self-piercing rivet 46 driven by rivet punch 40 to mechanically join two panels 58 and 60 to form workpiece 11. Although the exemplary rivet joint illustrated in FIG. 3 includes two interconnected sheet metal panels, rivet 46 may also be used to connect a different number of sheets. Panels 58 and 60 may be relatively thin sheet materials, for example sheet steel or aluminum. The two panels 58 and 60 may be connected with rivet 46 by using punch 40 to apply a driving force to rivet head 48, which drives rivet 46 into the sheet metal panels. Distal end 54 of rivet 46 is sufficiently sharp to pierce the stacked sheet metal panels when subjected to the driving force applied by punch 40 acting on rivet head 48 to mechanically interlock the two sheets. Shank 50 of rivet 46 typically pierces punch side sheet 58, but generally does not pierce bottom die side sheet 60. Die 36 includes a cavity 62 for receiving portions of the fastened sheet metal panels 58 and 60 forced outward by shank 50 of rivet 46 driven in by punch 40. Shank 50 and the material of bottom die side sheet 60 immediately adjacent distal end 54 of shank 50 are deformed through the action of die 36 in order to mechanically interlock the two sheets 58 and 60. The exact configuration of die 36 will depend, at least in part, upon the shape of a button that is to be formed.

Figure 4:
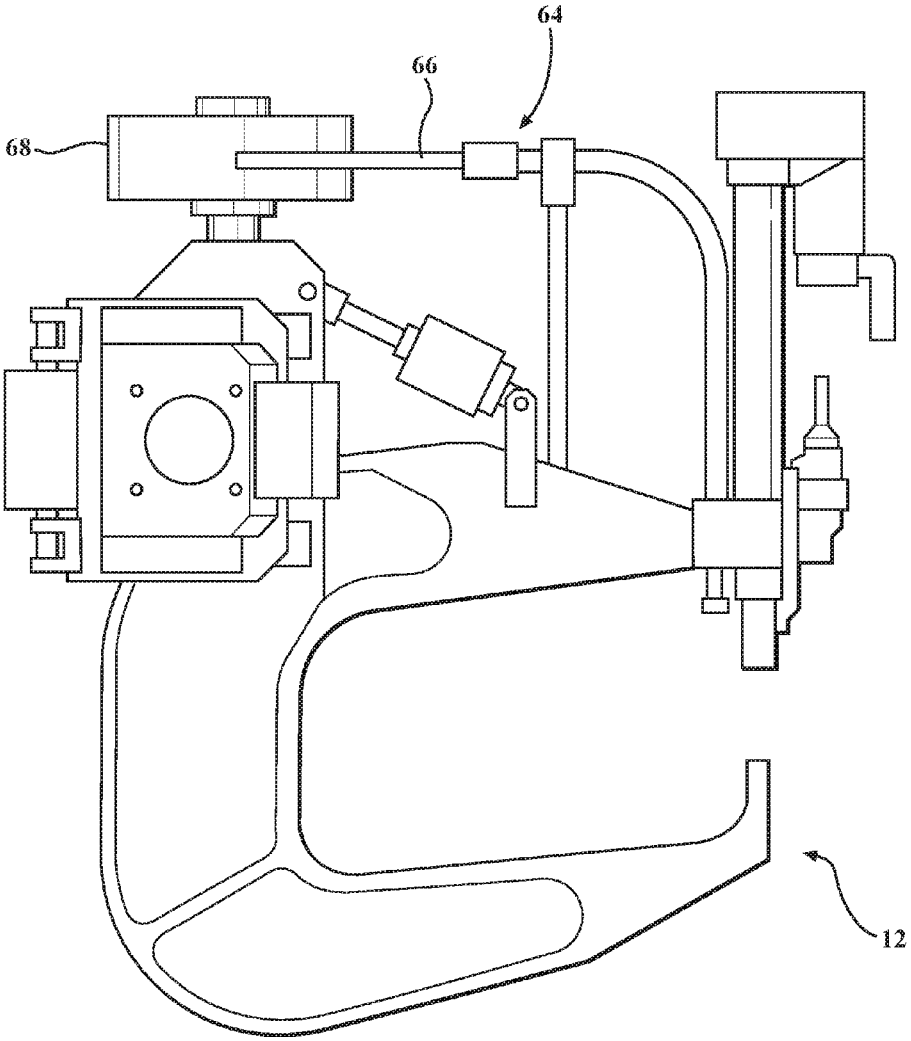
FIG. 4 is a schematic side view of an example of a conventional self-piercing rivet gun with a single rivet feed tape reel.
Figure 5A:
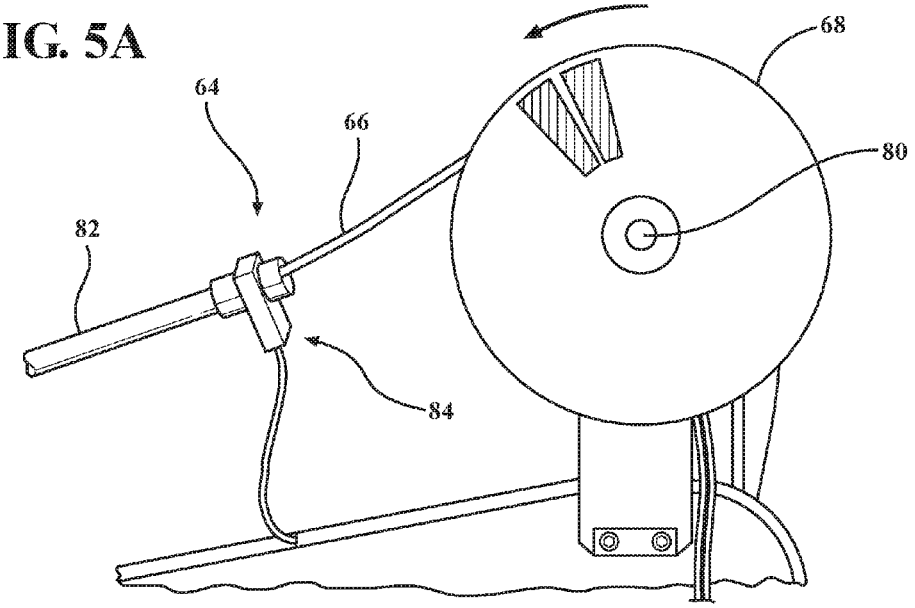
FIGS. 5A and 5B are side views of an alternate conventional rivet feeding device employing a single reel.
Figure 5B:
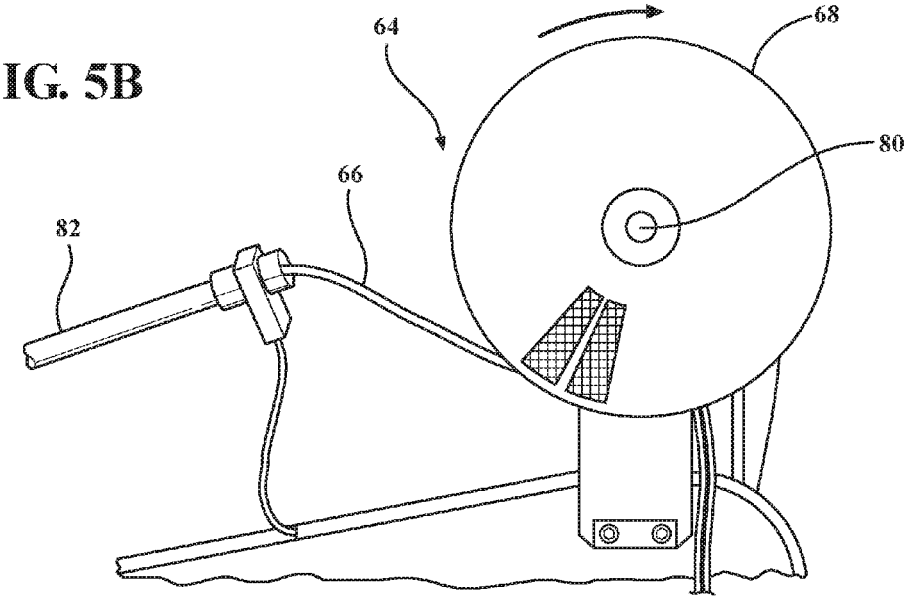

With reference to FIGS. 4 and 5, examples of a rivet tape feeder 64 may be employed for sequentially delivering single rivets 46 to rivet gun 12. Rivet feeder 64 may utilize an elongated flexible rivet carrier tape 66 for transporting rivets 46 from a rivet storage reel 68 to rivet gun 12. The example reel 68 is shown in a horizontal orientation in FIG. 4 and a vertical orientation in FIGS. 5A-B. Other forms of fastener or rivet reels 68 and their orientation to robot 14 and rivet gun 12 known by those skilled in the art may be used.

Figure 6A:
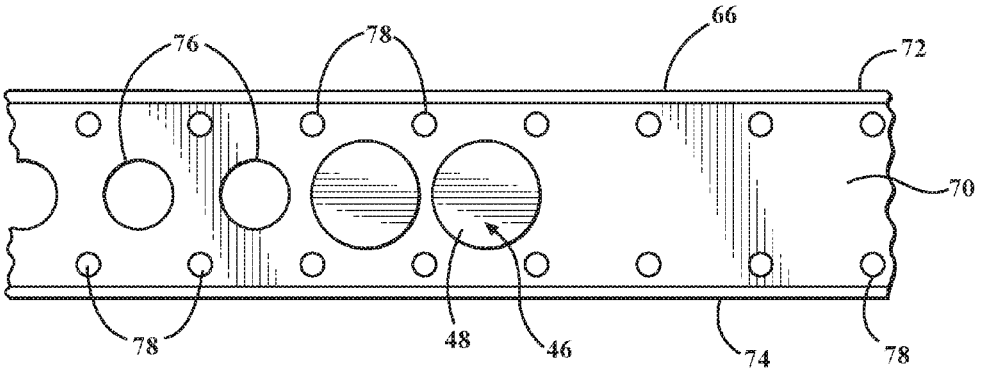
FIG. 6A is a top view of an example of a self-piercing rivet tape usable with the present invention.
Figure 6B:
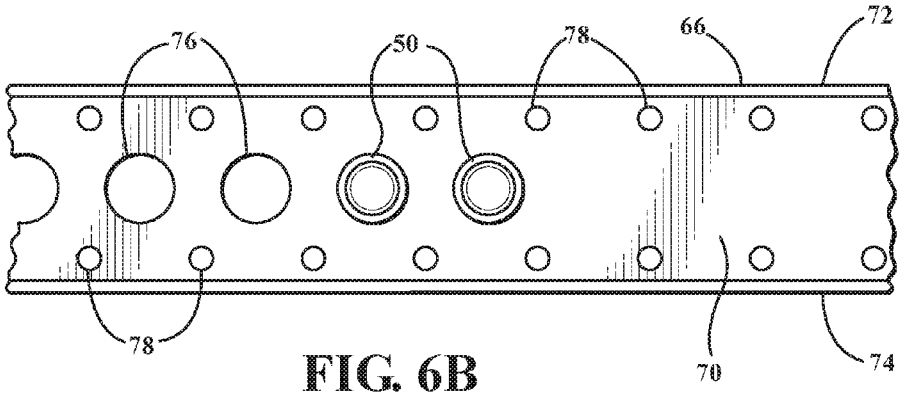
FIG. 6B is a bottom view of the rivet tape shown in FIG. 7A.
Figure 6C:
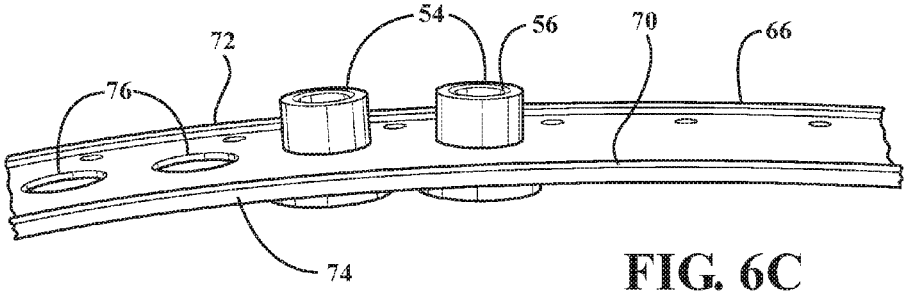
FIG. 6C is a front view of the rivet tape shown in FIG. 7B.

Referring to FIGS. 6A-C, an example of a rivet carrier tape 66 is shown. In the example, rivet carrier tape 66 may be made from an extruded polymer or elastomer material and includes a web 70 interconnecting parallel side flanges 72 and 74 arranged on opposite sides of web 70. Rivet carrier tape 66 may include a plurality of equally spaced apart apertures 76 arranged along a length of the tape for receiving and removably securing rivets 46. Apertures 76 may be undersize relative to a diameter of shank 50 of rivet 46 to securely retain rivets 46 on rivet carrier tape 66 prior to be installed into workpiece 11. Punch 40 may be sequentially actuated to drive each rivet 46 from rivet carrier tape 66 and into workpiece 11.

Rivet feeder 64 may be employed to feed rivet carrier tape 66 through rivet setting device 16 so that each rivet 46 becomes aligned with a path of punch 40 and is inserted by the punch into workpiece 11. Rivet carrier tape 66 may include drive apertures 78 positioned along the sides of web 70 adjacent side flanges 72 and 74. Drive apertures 78 may be engaged by pins on one or more drive sprockets (not shown) for feeding rivet carrier tape 66 into rivet setting device 16. Punch 40 may be actuated to sequentially drive each rivet 46 from rivet carrier tape 66 and insert the rivet into workpiece 11. Rivet feeder 64 may include an indexing mechanism (not shown) for sequentially feeding individual rivets 46 through rivet setting device 16.

Continuing to refer to FIGS. 5A and 5B, the exemplary storage reels 68 (a single reel shown in FIGS. 5A-B for ease of illustration only) may be configured generally as a spool and rotatably mounted to a shaft 80. Rivet carrier tape 66 dispensed from storage reel 68 may pass through a conduit 82 for guiding the rivet carrier tape into rivet setting device 16. Rivet feeder 64 may employ a top feed, as illustrated in FIG. 5A, and a bottom feed, as illustrated in FIG. 5B. Storage reels 68 may be rotated in a counterclockwise (as viewed from a perspective of FIG. 5A) to dispense rivet carrier tape 66 when employing the top feed arrangement, and storage container 68 may be rotated in a clockwise direction (as viewed from a perspective of FIG. 5B) to dispense rivet carrier tape 66 when employing the bottom feed arrangement.

With reference to FIGS. 7-11D, an example of a continuous feed rivet system employing two reels is shown. In the example rivet feeder 86 includes primary or first rivet supply reel 88 and a backup or second rivet supply reel 90. Primary reel 88 and backup or secondary reel 90 may be similarly configured as rivet storage reel 68 as previously described. In a preferred example, for example at the start of an assembly plant shift, each of the primary 88 and secondary 90 reels are stocked or wound with a supply of rivets 46 attached to rivet carrier tape 66. Depending on the fasteners and sizes used, hundreds or over a thousand rivets may be initially stored on each reel for selected delivery to rivet setting device 16 to support a high-volume production build.

Figure 7:
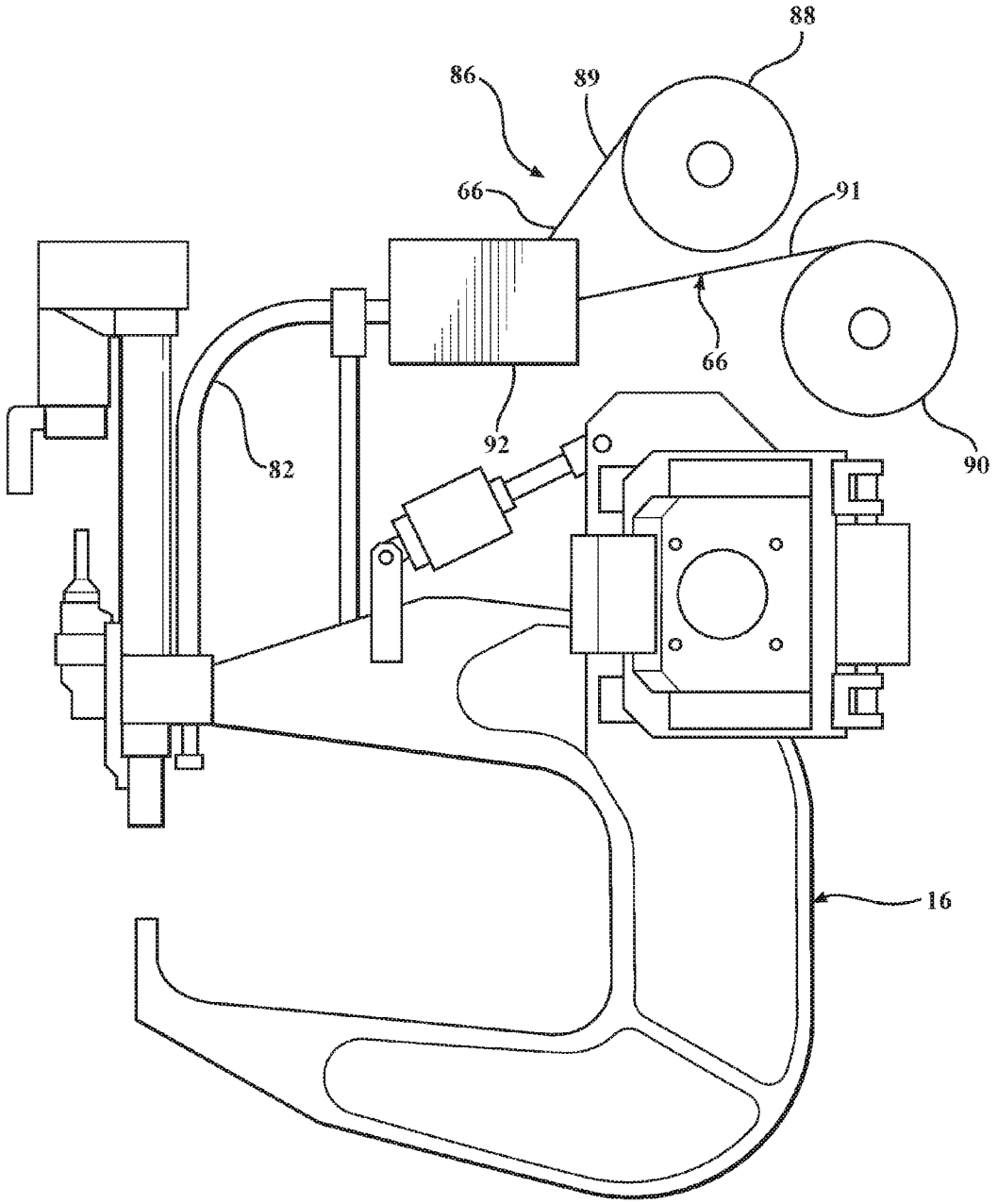
FIG. 7 is a schematic side view of an example of the present invention with two rivet feed reels and escapement device.
Figure 8:
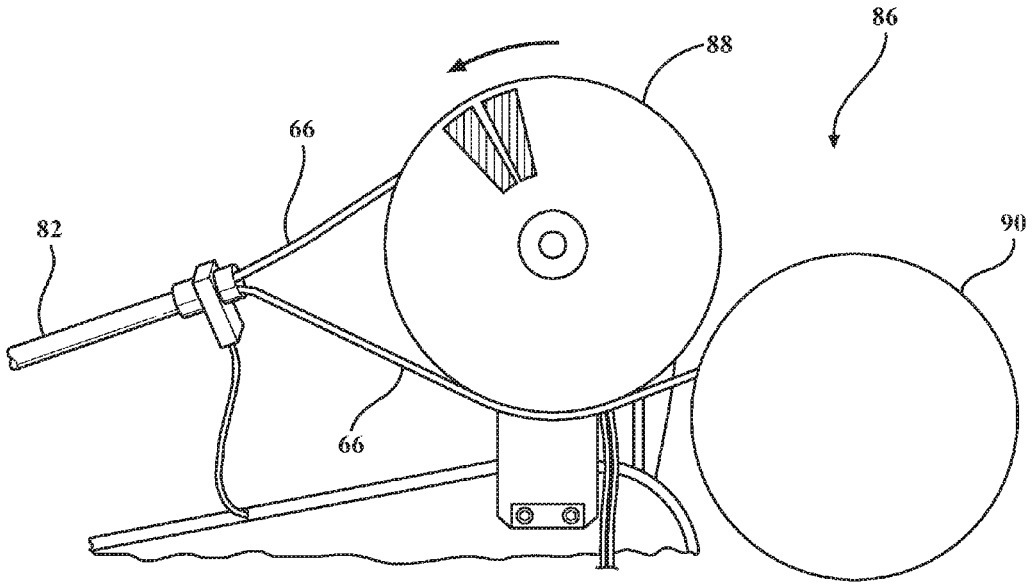
FIG. 8 is a schematic side view of an example of the present invention with two rivet feed reels.
Figure 9:
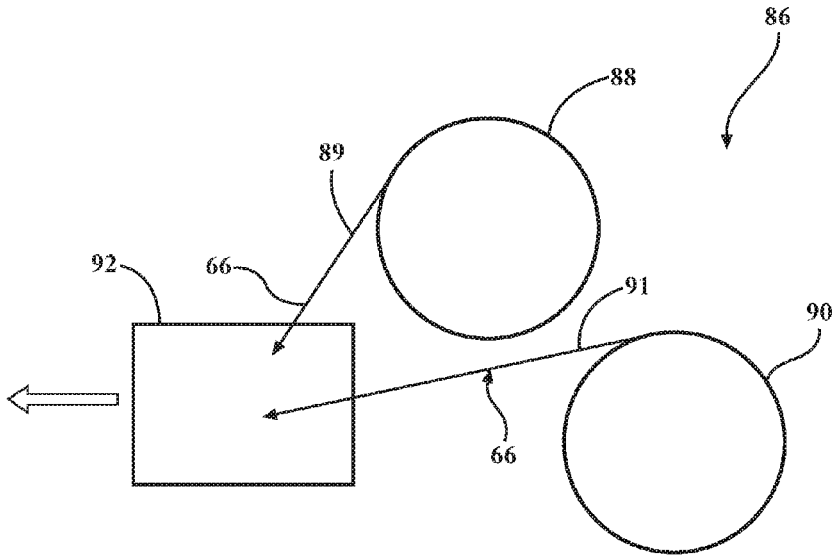
FIG. 9 is a schematic side view of an example of the present invention with two rivet feed reels.

In one example of system 10, each of the primary 88 and secondary 90 reels are mounted on a reel carrier (not shown) in a front-to-back orientation as generally shown in FIGS. 7-9. In this orientation, a primary rivet tape 89 carrying rivets 46 is aligned for feeding rivets to rivet gun 12 through selected movement of the tape by a driving devices as previously described. Secondary reel 90 is also positioned in general alignment for feeding a separate, secondary rivet tape 91 carrying rivets 46 to rivet gun 12 when the primary reel rivet supply is exhausted in the manner described below. It is understood that the position and orientation of the primary 88 and second reels 90 may vary from the illustrated position depending on the packaging space available and the feed system used by the particular rivet gun 12 as known by those skilled in the art. Although two reels are shown, it is contemplated that more than two reels may be used depending on the assembly operation and fasteners that are required.

Figure 10A:
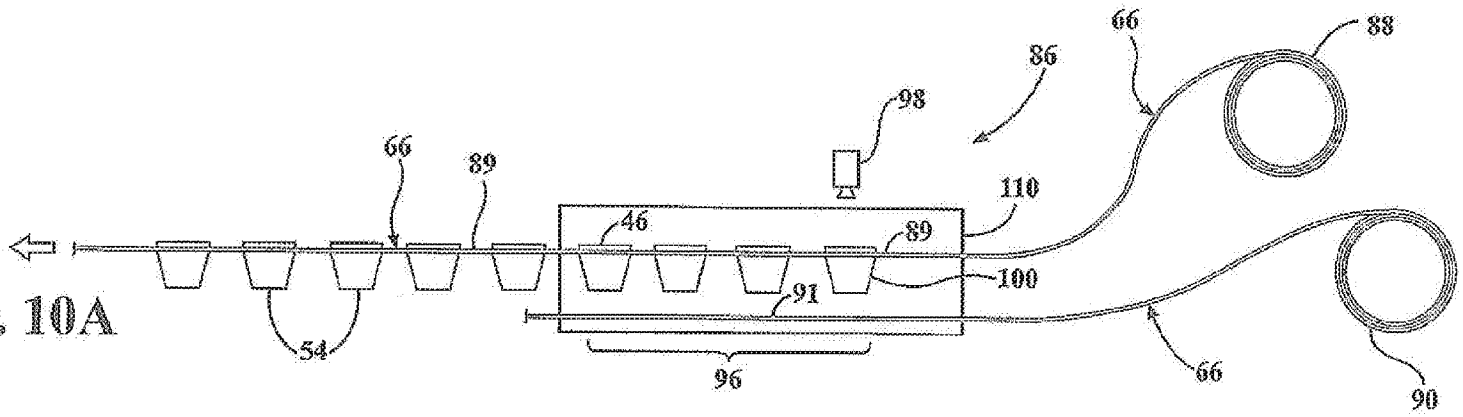
FIGS. 10A-D are schematic sequential and progressive process steps illustrating the transfer of feeding self-piercing rivets from a primary rivet feed reel to a secondary or backup feed reel.

Referring to FIGS. 10A-D, the example rivet setting system 10 includes a rivet carrier tape escapement or merging device 92 to guide and selectively link the first rivet tape 89 to the second rivet tape 91 for continuous supply of fasteners, preferably self-piercing rivets, to rivet gun 12. In the example escapement device 92, both of the first or primary rivet tape 89 and backup or secondary rivet tape 91 enter a first end in preferably longitudinal alignment, the first tape 89 positioned directly above the second tape 91 with a vertical space between the tapes as generally shown in FIG. 10A. In this orientation, rivets are selectively taken from primary reel 88 through advancement of first tape 89 through the escapement device 92 as previously described.

In the orientation shown in FIG. 10A, a lead section 96 of second rivet carrier tape 91 lies idle and does not advance toward the rivet gun 12. In a preferred example, lead section 96 of the second tape 91 does not include rivets 46 in several of the apertures 76 as generally shown in FIG. 6A (left side).

Figure 10B:
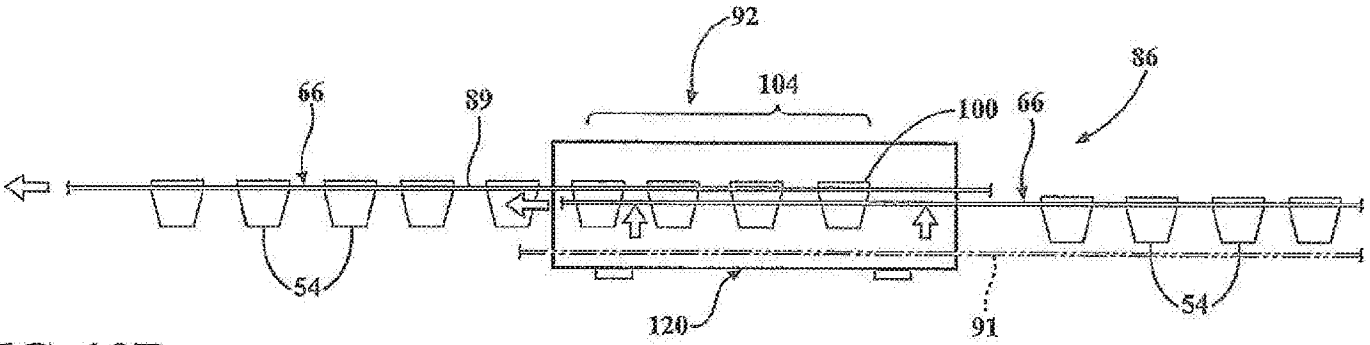

Referring to FIG. 10B, when the primary reel 88 is near depletion of rivets, a tail section 104 of the first tape 89 enters the escapement device first end 110. In a preferred example, the tail end includes several rivets 46 with the respective shanks extending downward in a direction toward the lead end of the second tape 91 positioned generally below the first tape as generally shown.

In the example, escapement device 92 includes a tape joining mechanism 120 which operates to selectively position lead section 96 of second tape 91 into engaging position with the tail section 104 of first tape 89 prior to the tail section 104 passing completely through the escapement device 92. In the example shown, tape joining device 120 can include a plate, rail or other component that supports and assists in alignment of second tape 91 in the position shown and described in FIG. 10A. When activated, joining device 120 may forcibly raise second tape 91 into contact with the protruding rivets 46 extending downward from the first tape 89 wherein the shanks 50 of one or more rivets 46 in the tail end 104 of the first tape engage respective apertures 76 in the second tape 91 to interlock the first 89 and second 91 tapes together such that the second tape 91 begins to advance toward rivet gun 12. In one example, tape joining device may be a pneumatically operated lift or servo motor operated device connected to a lower portion of the escapement device. Alternately, the elevated first tape 89 may be forcibly moved downward toward the second tape 91 positioned below in a similar manner. In another example (not shown), dual devices may simultaneously operate to lower the first tape 89 and raise the second tape 91 into engagement to "pinch" the two tapes into engagement. Other tape joining schemes, for example features on the tape substrate itself which may engage or interlock the tapes together, for example integrated hooks or catches molded into the tapes, known by those skilled in the art may be used. Further, alternate tape joining devices which physically move and position the tapes together known by those skilled in the art may be used.

Figure 10C:
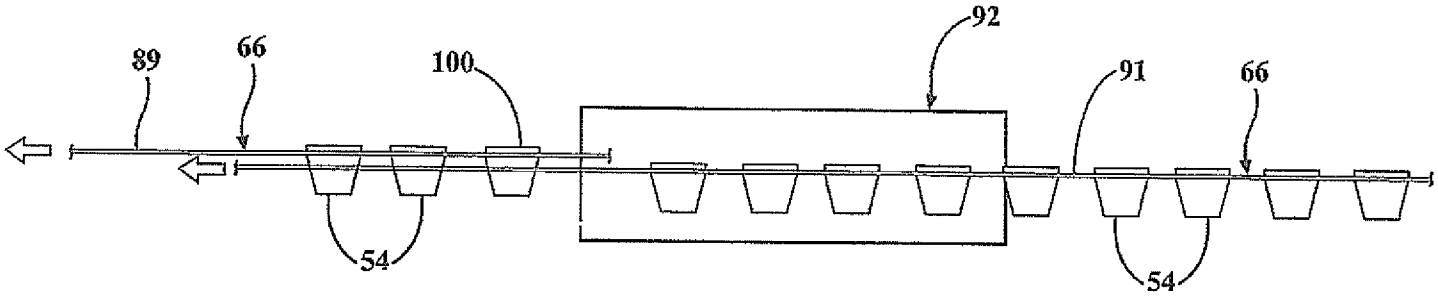
Figure 10D:
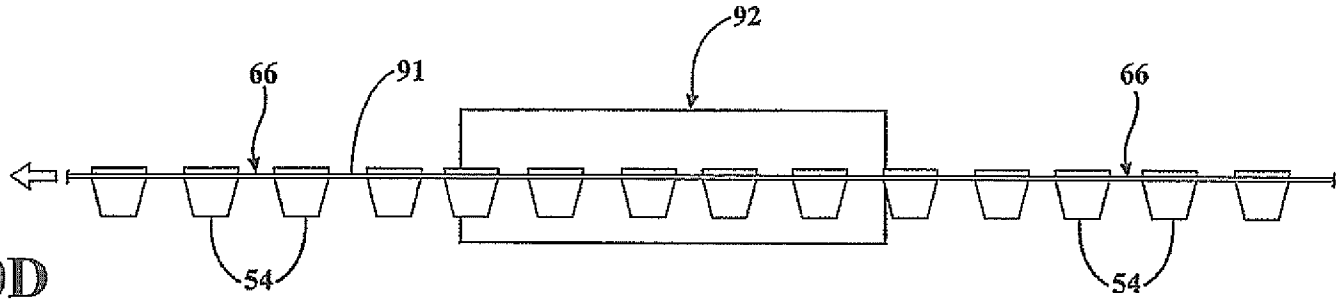
Figure 11B:
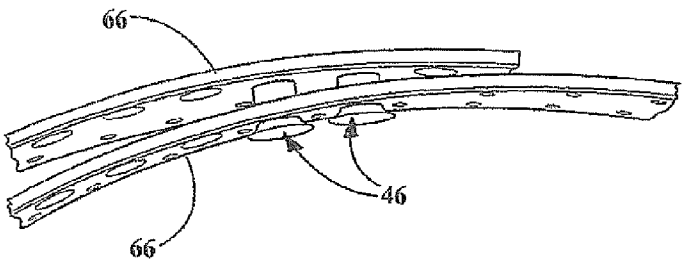
FIGS. 11A-D are alternate sequential and progressive steps showing an example of engagement between the trailing end of the primary rivet reel tape to the leading end of the secondary reel tape.
Figure 11D:
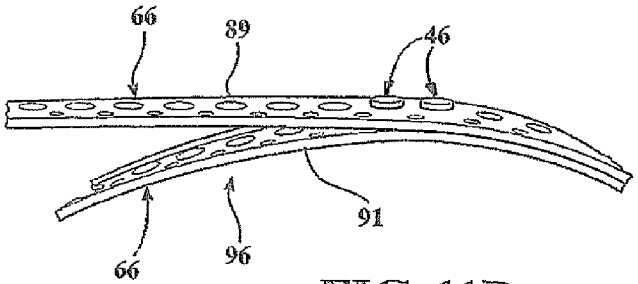
Figure 11A:
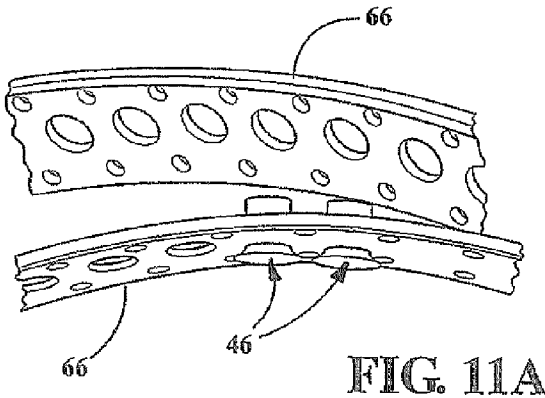
Figure 11C:
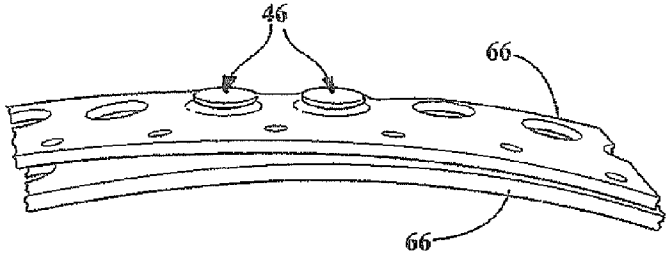

Referring to FIGS. 10C and D, on joining of the first tape 89 to the second tape 91 in one of the manners described, the second rivet reel 90 this is operable to provide a full stock of rivets to the rivet gun 12. In conventional fastener and rivet feed devices, the robot would have to be idled and the rivet reel replaced requiring manual intervention and a loss of valuable manufacturing time. In additional, much effort and time is spent on conventional devices attempting to track when a single reel or other rivet storage device would run empty. Often, in an attempt to minimize the robot downtime, conventional reels and cartridges would just be replaced before the fasteners were depleted which wastes the rivets.

As shown in FIGS. 5A and 10A, one or sensors 84 and/or 98 may be used to monitor or detect the presence or absence of rivets or the movement of one or both of the reels 88 and 90. In one example shown in FIG. 10A, a sensor 98 may be employed to detect the presence of rivets 46 on the first tape 89 received from primary spool 88. Upon detecting a final trailing rivet 100 (or alternately detecting the absence of a rivet following the last rivet 100 on the tail end 104) on the first tape 89 from primary reel 88, sensor 98 may transmit a signal to a controller indicating that primary spool 88 is exhausted, or about to be exhausted, of rivets 46. The controller may then activate tape joining mechanism 120 in response to the signal received from sensor 98, instructing tape joining mechanism 120 to move lead section 96 of second tape 91 received from backup reel 90 into engagement with rivet carrier tape 66 received from primary spool 88, as illustrated, for example, in FIG. 10B. Alternate or additional sensors, for example vision systems, and other sensors and/or detectors, which are capable of providing electronic and/or visual notices or indicators to plant personnel of one or more conditions may be used as known by those skilled in the art.

As shown in FIG. 5A, an alternate or additional sensor 84 may be mounted to one or more of the primary 88 and second 90 reels which detects movement or stoppage of movement of the reels, for example when the primary 88 is depleted of rivets and stops rotating and/or the second reel 90 begins rotation signaling that the first reel 88 has been depleted and the rivet gun device is now operating on the second reel of rivets.

The controller (not shown) may be configured to send an electronic and/or visual signal to notify an equipment operator or maintenance personnel that primary reel 88 is exhausted of rivets 46 and should be replaced. By having the second reel 90 automatically and fully supporting the ongoing assembly operations, this provides the assembly plant significantly more time to replace the now depleted primary reel 88 providing for a continuous supply of rivets to the rivet gun 12 and greatly simplifies and improves the manual operations associated with the often hundreds of fastener robots that are deployed in large, high-volume vehicle assembly plants.

In one example not shown, the rivet reel support rack may include features to easily and quickly remove a depleted reel with a fully-stocked reel. In one example, the reel rack may also allow for the now feeding second reel 90 to be moved into the position of the depleted first reel which has been removed while the second reel 90 continues to feed rivets to the rivet gun 12. In the example where the rivet shanks are used to engage the tapes, this may be necessary to ensure that the lower or second reel 90 having a leading end with empty apertures 76 is positioned below the feeding reel so as to interlock the tapes as described above.

In yet another example, the second reel can remain in its original position and the rivet joining device 120 is adjusted to take into account that the lower reel is now feeding so as to forcibly push the leading edge of the upper tape into engagement with the lower feeding tape when the lower tape is almost depleted.

In a method or process for a continuous feed of fasteners or rivets, a sequence of sequential steps or processes using the above described components is used as described and illustrated. Additional steps may be added, steps may be removed and the order of steps may change as understood by those skilled in the art.

It is to be understood that the described and illustrated invention is not to be limited to the disclosed examples but, on the contrary, is intended to cover various modifications and equivalent arrangements included within the spirit and scope of the disclosure and appended claims which scope is to be accorded the broadest interpretation so as to encompass all such modifications and equivalent structures as is permitted under the law.

What is claimed is:

1. A continuous fastener feeding device for use in sequentially delivering single fasteners to a fastener installation device, the feeding device comprising:

a first fastener reel for supporting a first fastener tape securing a plurality of fasteners;

a second fastener reel for supporting a second fastener tape securing a plurality of fasteners, wherein the plurality of fasteners in the first and second fastener tapes are retained within apertures defined in the first and the second fastener tapes; and a fastener tape joining device positioned downstream of the first and second fastener reels, the joining device operable to receive the first and second fastener tapes and selectively position a lead section of the second fastener tape into engagement with a tail section of the first fastener tape, the lead section of the second fastener tape not including fasteners in the apertures defined in the second fastener tape, the joining device further operable to forcibly move the first fastener tape and the second fastener tape together to allow protruding portions of the fasteners of the tail section of the first fastener tape to engage the apertures defined in the lead section of the second fastener tape thereby engaging the first and second fastener tapes when one of the first and second fastener tapes becomes depleted of fasteners.

2. The feeding device of claim 1 further comprising:

a controller to activate the joining device; and at least one sensor to detect a presence of the fasteners in the first fastener reel or the fasteners in the second fastener reel, wherein the controller is configured to activate the tape joining device in response to a signal received from the at least one sensor.

3. The feeding device of claim 1, wherein the fasteners of the first and second fastener tapes comprise self-piercing rivets.

4. The feeding device of claim 1, wherein the fasteners secured by the first fastener tape are different from the fasteners secured by the second fastener tape.

5. The feeding device of claim 1 further comprising a fastener reel support rack to retain the first fastener reel and the second fastener reel, wherein the support rack allows for movement of the second fastener reel to a position of the first fastener reel subsequent to the first fastener reel being depleted of fasteners.

6. The feeding device of claim 1 wherein the second fastener tape is configured to enter the tape joining device in a position that is lower than a position of the first fastener tape.

7. A rivet setting system for fastening two materials together using self-piercing rivets, the rivet setting system comprising:

a self-piercing rivet gun for installation of rivets along an assembly line;

a first fastener reel for supporting a first rivet tape defining apertures operable to secure a plurality of self-piercing rivets, a portion of each of the self-piercing rivets protruding from a tail section of the first rivet tape;

a second fastener reel for supporting a second rivet tape defining apertures operable to secure a plurality of self-piercing rivets, the second rivet tape having a lead section which does not have rivets in the apertures;

a rivet reel support rack to retain the first and second fastener reels; and a rivet tape joining device positioned downstream of the first and second fastener reels, the rivet tape joining device operable to receive the first and second rivet tapes and selectively forcibly move the first rivet tape and the second rivet tape together to allow the portions of the self-piercing rivets protruding from the tail section of the first rivet tape to engage the apertures in the lead section of the second rivet tape when the first rivet tape becomes depleted of rivets.

8. The rivet setting system of claim 7 further comprising:

at least one sensor to detect a presence of rivets in the first fastener reel or the second fastener reel; and a controller configured to activate the rivet tape joining device in response to a signal received from the at least one sensor.

9. The rivet setting system of claim 7 wherein the rivet reel support rack allows for movement of the second fastener reel to a position of the first fastener reel subsequent to the first fastener reel being depleted of rivets.

* * * * *